19-306

10/15/85 XP 4,546,622

United States Patent [19]

Seidel et al.

[11] Patent Number: 4,546,622

[45] Date of Patent: Oct. 15, 1985

[54] CIRCULAR KNITTING MACHINE FOR PRODUCING KNIT GOODS HAVING ENMESHED FIBERS

[75] Inventors: Adolf Seidel; Peter Artzt; Gerhard Egbers, all of Reutlingen; Helmut Grimm, Neckartailfingen; Klaus Künde, Kohlberg; Anton Schenek, Bempflingen, all of Fed. Rep. of Germany

[73] Assignee: Sulzer Morat GmbH, Fed. Rep. of Germany

[21] Appl. No.: 475,389

[22] Filed: Mar. 14, 1983

[30] Foreign Application Priority Data

Apr. 3, 1982 [DE] Fed. Rep. of Germany ..... 3212580

[51] Int. Cl.[4] ..... D04B 9/14; D01G 15/40

[52] U.S. Cl. ..... 66/9 B; 19/306

[58] Field of Search ..... 19/288, 292, 303, 306; 66/9 B

[56] References Cited

U.S. PATENT DOCUMENTS

| | | | |
|---|---|---|---|
| 3,576,349 | 4/1971 | Mark | 19/303 X |
| 3,755,856 | 9/1973 | Banks | 19/306 X |
| 3,916,485 | 11/1975 | Doudlebsky et al. | 19/105 X |
| 3,999,250 | 12/1976 | Brown et al. | 19/303 |
| 4,224,720 | 9/1980 | Morgner et al. | 19/303 X |
| 4,315,347 | 2/1982 | Austin et al. | 19/306 X |
| 4,364,152 | 12/1982 | Rauschen et al. | 19/288 X |

OTHER PUBLICATIONS

Shinn, *Principals of Knitting,* vol. 1, 1957, pp. 320, 322, 323.

*Primary Examiner*—Wm. Carter Reynolds

[57] ABSTRACT

A circular knitting machine for the production of knit goods with combed-in fibers, has a rotating needle cylinder in which needles having hooks for receiving fibers are mounted, at least one carding device having a feed apparatus for feeding a fiber strand, a separating apparatus for separating the fiber strand into a stream of individual fibers, and a combing-in zone through which the needles pass, and wherein the fibers are carried within the fiber stream for the purpose of contactlessly combing-in the fibers into the hooks of the needles. Guides are provided ahead of the combing-in zone for the purpose of dividing the fiber stream into partial fiber streams, thus considerably reducing or varying the percentage of fibers which are bound across several neighboring loops by several neighboring needles.

14 Claims, 8 Drawing Figures

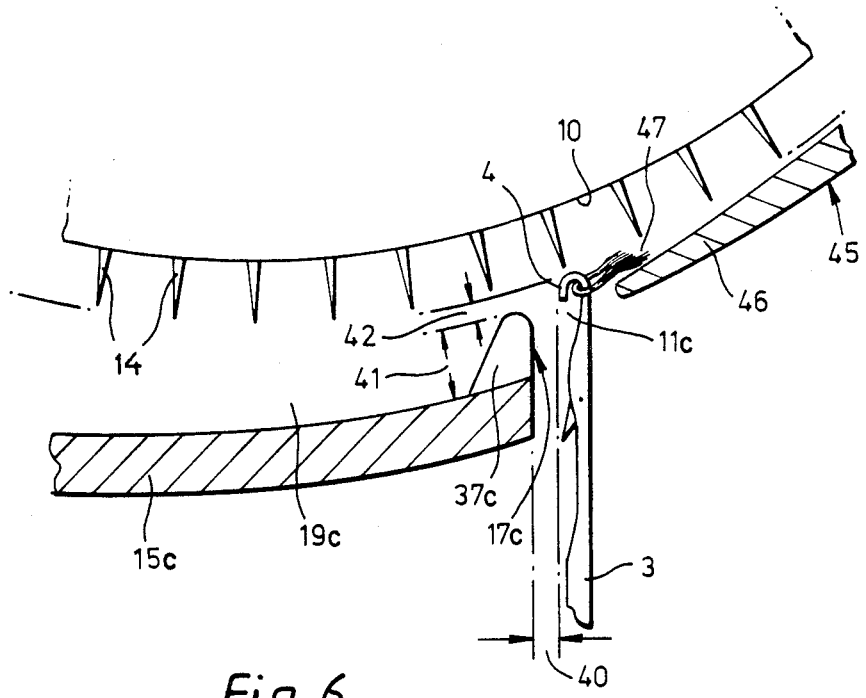
Fig. 6.
Fig. 7.
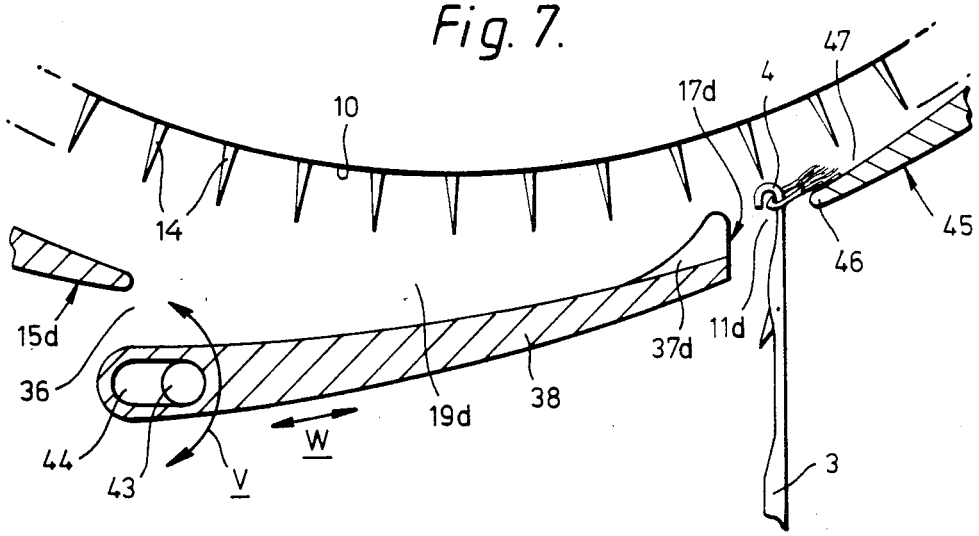

CIRCULAR KNITTING MACHINE FOR PRODUCING KNIT GOODS HAVING ENMESHED FIBERS

BACKGROUND OF THE INVENTION

The invention relates to a circular knitting machine.

The carding devices of all circular knitting machines of this kind used for industrial purposes contain at least one separating cylinder or card cylinder to which a fiber strand is fed, and a transfer cylinder for receiving and transferring the fibers prepared by the separating cylinder to the hooks of the knitting needles. The separating and transfer cylinders are provided with flexible wire hooks projecting outwardly and meshing with one another, and the transfer of the fibers from the transfer cylinders to the hooks of the knitting needles is accomplished by running the latter through the wire hooks of the transfer cylinder (U.S. Pat. Nos. 3,896,636 and 3,896,637 and British Pat. No. 177,472). The mechanical meshing of the wire hooks of the transfer cylinder with the wire hooks of the separating cylinder results in great mechanical wear and an undesirable interdependence between the rotatory speed of the separating cylinders and transfer cylinders.

Therefore circular knitting machines have become known which have devices for the contactless transfer of the fibers to the needle hooks, the term "contactless" meaning that the needle hooks do not pass through any kind of card clothing, and preferably also no cylinders have to be provided having intermeshing card clothing. Such knitting machines have a means for pulling the fiber strand apart, which is followed by a transport channel carrying the singled fibers in a stream, whereby the fibers are laid into needle hooks moving across the fiber stream. All other known circular knitting machines with contactless fiber transfer are made in a similar manner (German Pat. Nos. 97,374 and 1,585,081, German Auslegeschrift No. 1,785,465 and German Offenlegungsschrift Nos. 2,253,659, and 2,430,867 and U.S. Pat. No. 3,996,770), but they have not been put to practical use because the transfer of the fibers to the needle hooks is unreliable.

Experiments on a similar circular knitting machine in accordance with an as yet unpublished proposal of the same applicant (Patent Application P 3,107,714), which has a carding cylinder driven at high circumferential velocity and distinguishes itself from the known machines by an extremely short transport passage free of directional changes for the fiber stream, and therefore a very uniform fiber transfer, have shown that the fibers often are bound into the loops of the knit goods, not just by one needle but by several adjacent needles. This results in a strengthening of the knit goods in the direction of the rows of stitches, which in some cases may be desirable, but in many applications is not. Probably this phenomenon is caused by the fact that the fiber stream transporting the fibers from the carding device to the needle hooks contains a marked percentage of fibers lying across the fiber stream, which upon encountering the needle hooks are laid simultaneously into several needle hooks.

The invention is therefore addressed to the problem of creating, on a circular knitting machine with contactless fiber transfer of the kind specified in the beginning, by means of which the percentage of the fibers bound across several loops by several needles can be influenced and thus either considerably reduced or varied between two limit values.

BRIEF DESCRIPTION OF THE INVENTION

The distinctive features of claim 1 are provided for the solution of this problem.

Additional advantageous features of the invention will be found in the subordinate claims.

The invention presents the surprising advantage that splitting the fiber stream into a plurality of streams by guide means located between the separating device and the transfer zone has a remarkable effect on the percentage of fibers which are bound into the knit goods by more than one loop. In particular it is possible almost completely to prevent the binding of fibers by more than one loop, and therefore to make knit goods in which the fibers are each bound in by one loop, as they are in the goods manufactured with transfer cylinders. By the appropriate arrangement and/or dimensioning of the guide means, however, it is also possible to control the percentage of fibers bound in by several loops for the purpose of producing knit goods of higher or lower cross stretch or with a cross stretch that alternates according to a pattern, depending on the application. Although the cause of the action of the guide means of the invention is not yet fully understood, it is assumed that, the number of fibers disclosed transversely in the fiber stream is influenced by the guides, or at least the guides prevent transverse fibers from being transferred to more than one needle hook.

The invention will be further explained below with the aid of embodiments, in conjunction with the appended drawings.

BRIEF DESCRIPTION OF THE DRAWINGS

FIGS. 5 to 7 represent diagrammatically three cross sections corresponding to FIG. 3, taken through three embodiments of the invention, only the area that includes the transfer zone being represented on a larger scale.

DESCRIPTION OF PREFERRED EMBODIMENTS

Figure 1:
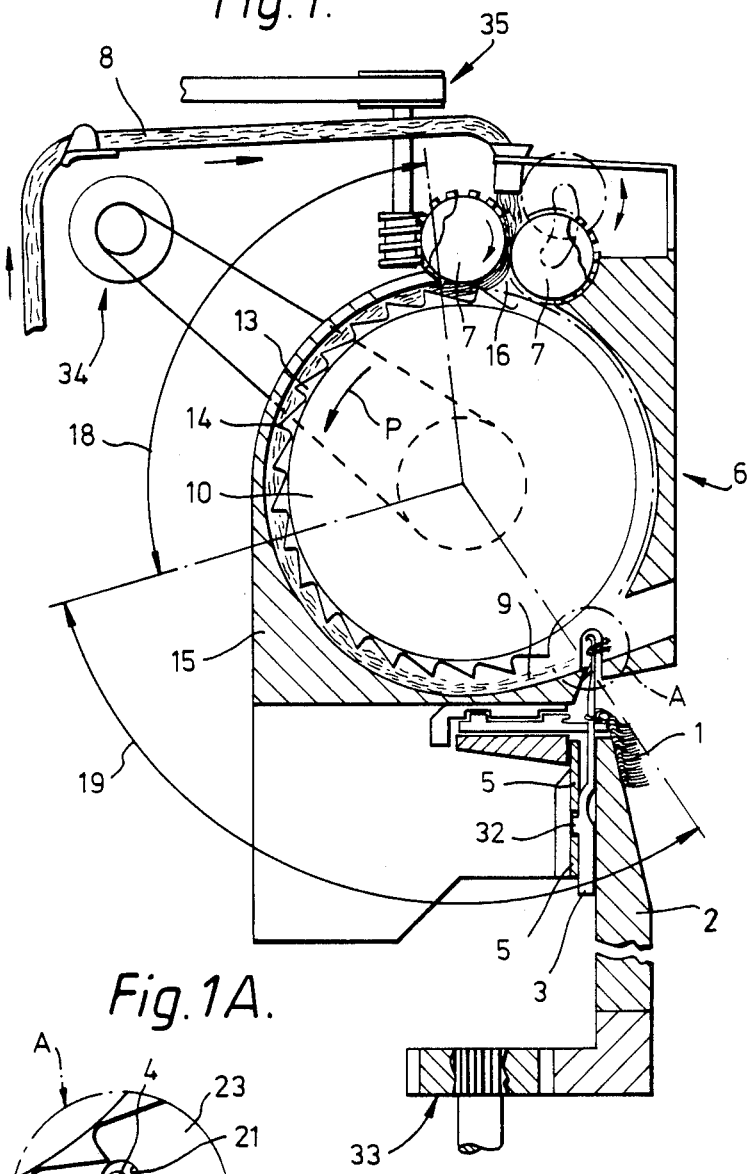
PRIOR ART Fig. 1.
FIG. 1 is a longitudinal cross section through a circular knitting machine in accordance with U.S. Pat. No. 4,458,506 and showing the PRIOR ART.

In accordance with FIG. 1 and U.S. Pat. No. 4,458,506 a circular knitting machine for the production of knit goods 1 with enmeshed fibers has a needle cylinder 2, which as a rule is rotatable, and in which vertically displaceable knitting needles 3 with hooks 4 are mounted, which are driven up and down in the area of at least one knitting system by means of stationary cam parts 5 for the purpose of making a ground fabric from yarns which are not shown. The fibers of the sliver or strand are pulled apart and incorporated into the knit goods by means of at least one carding device 6 associated with the knitting system and having a means for feeding a sliver or strand 8 of fibers, such means consisting of two feed rolls 7, a strand opening device in the form of the separating or card cylinder 10 for pulling the fiber strand 8 apart into single fibers 9, and a combing-in or transfer zone 11 through which the knitting needles 3 travel for the purpose of catching the fibers 9 on their hooks 4.

The fiber strand 8 is pulled apart by means of the card cylinder 10 rotating in the direction of the arrow P, which is equipped with a card clothing 13 having outwardly projecting hooks 14. The card cylinder 10 is driven at a substantially greater circumferential speed than the feed rolls 7 and therefore pulls the fiber strand 9 apart into the single fibers 9.

To prevent the fibers seized by the card hooks 14 of the card clothing 13 from being flung back off the hooks 14 by the great centrifugal forces produced by the high speed of the card cylinder 10, the carding device 6 includes a cover or shroud 15 confronting the outer circumferential surface of the card cylinder 10, an entry aperture 16 to admit the fiber strand 8 delivered by the feed rolls 7, and an exit aperture 17 for the discharge of the fibers 9 into the transfer zone 11, the shroud being continuous at least from the entry aperture 16 to the exit aperture 17 along the path of the fibers. The shroud 15 thus defines a sliver opening and accelerating section 18, indicated by an arrow, and beginning directly at the entry aperture 16, in which the shroud 15 is at a short but constant distance of, for example, less than one millimeter from the tips of the hooks of the card cylinder 10. The opening and accelerating section 18 is then followed by a throw-off section 19 which terminates at the exit aperture 17 and is at a distance from the tips of the card hooks 14 which gradually increases in the direction of rotation to a value of, for example, several millimeters.

Within the sliver opening and accelerating section 18, the distance between the shroud 15 and the tips of the card hooks 14 is so small that the fibers caught by the card hooks 14 at the entry aperture 16 are held fast by the hooks and transported, without the formation of fiber pile-ups between the shroud 15 and the card hooks 14 or the separation of fibers from the stream due to loose fibers being released prematurely from the hooks by centrifugal force. Within the throw-off section 19, however, the fibers can be released from the card hooks 14 under the influence of the centrifugal force. The released fibers are thrown off substantially tangentially into the air stream which automatically forms in the direction of the arrow P due to the high rotatory speed between the shroud 15 and the circumferential surface of the card cylinder 10 on the one hand and between the entry aperture 16 and the exit aperture 17 on the other, and they are carried at least also through the transfer zone 11 immediately following the exit aperture 17, through which the hooks 4 of the knitting needles are traveling.

Figure 1A:
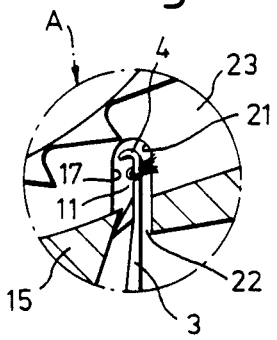
FIG. 1*a* is an enlargement of the circle marked "A" in FIG. 1.
Figure 2:
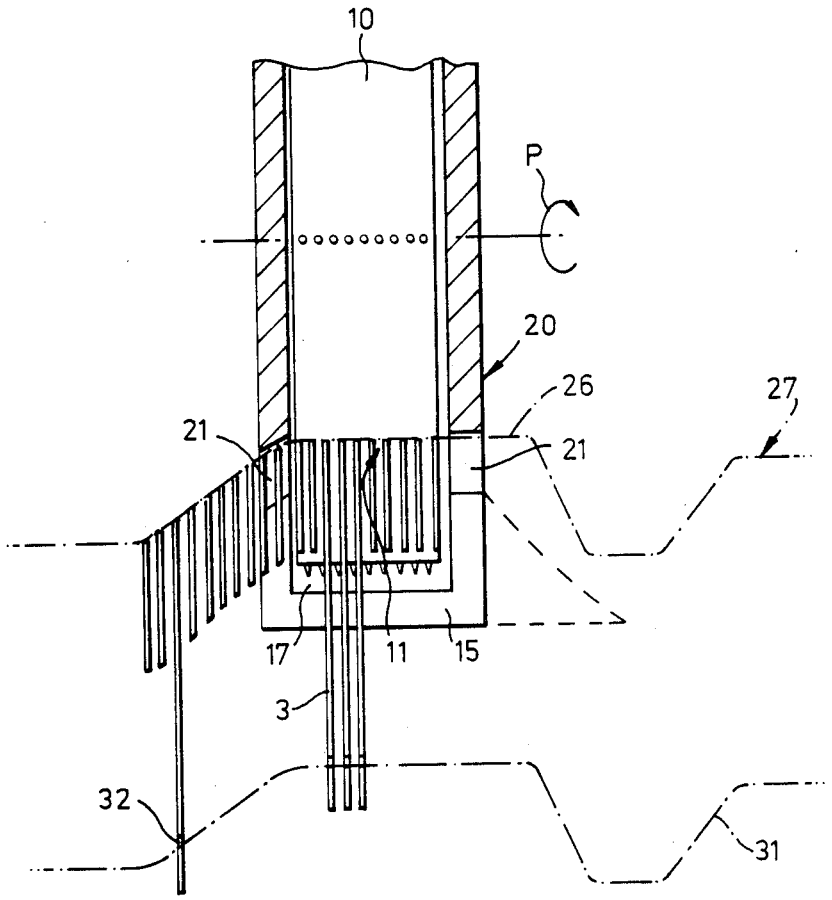
PRIOR ART Fig. 2.
FIG. 2 is a diagrammatic representation of the circular knitting machine of FIG. 1 as viewed from in back of the knitting needles.

The shroud 15 is, as indicated in FIGS. 1 and 2, best made a part of a casing 20 enveloping the card cylinder 10 and the transfer zone 11. Each of the side walls of this casing has a cutout 21 on the transfer zone 11 for the passage of the knitting needles, while in the floor of the casing there is formed a slot 22 disposed preferably transversely of the direction of flow of the fibers as shown in FIG. 1A. The openings 21 and the slot 22 are in a part of the casing which forms a passage 23 adjoining the downstream side of the transfer zone 11, and channels the fiber stream after its passage through the transfer zone. On the basis of this design, the transfer zone 11 can be situated directly adjacent the circumference of the card cylinder, but at a slight distance away from it, without allowing contact between the hooks 4 of the knitting needles 3 and the hooks 14 of the card clothing 13.

The transfer zone 11 consists, as seen in FIGS. 1 and 2, of a section 26 of a path 27 which is traveled by the tips of the hooks 4 of knitting needles 3 during the conventional rotation of the needle cylinder 2. Section 26 is disposed parallel to the axis of the card cylinder 10 and at such a height that the hooks 4 of the knitting needles 3 are very close to the tips of the hooks 14 of the card cylinder 10 while they are catching the fibers, but they do not touch them. The shape of the path 27 depends on the shape of the cams 5 which act on the butts 32 of the knitting needles 3, which follow a path 31.

As seen in FIGS. 1 and 2, the entry aperture 16 and the transfer zone 11 are disposed directly at the circumference of the card cylinder 10, so that only the card cylinder 10 is needed for the entire sliver opening and transferring process. Since furthermore no changes of direction or other interference will be encountered by the stream of fibers between the card cylinder 10 and the knitting needles 3, the uniformity of the fiber feed is extremely great.

With the card cylinder 10 there is associated a drive 34 (FIG. 1) which is independent of the common needle cylinder drive 33 (FIG. 1), and which drives the card cylinder 10 at a rotatory speed that is constant at all knitting machine speeds or can be adapted to some extent to particular knitting machine speeds and/or to the characteristics of the fibers. In any case, the circumferential velocity of the card cylinder 10, when in operation, is relatively great, and preferably at least about four to ten times greater than the needle velocity resulting from the rotatory speed of the needle cylinder. The circumferential velocity of the card cylinder 10 amounts preferably to more than fifteen meters per second at needle cylinder circumferential velocities of a maximum of about 1.5 meters per second. The feed rolls 7, however, are driven in synchronism with the rotatory speed of the needle cylinder by means of a conventional drive 35 (FIG. 1), and in the above example they have circumferential velocities which, at the maximum cylinder rotatory speed, are approximately a hundred times lower than the circumferential velocity of the card cylinder 10. At the same time, the feed rate of the feed rolls 7 can be varied according to the weight of the strand. On account of the great difference between the rate of feed of the fiber strand 8 and the circumferential speed of the card cylinder 10, a great draft is exerted on the fiber strand 8 and therefore an extremely good singling of the fibers is accomplished.

Figure 3:
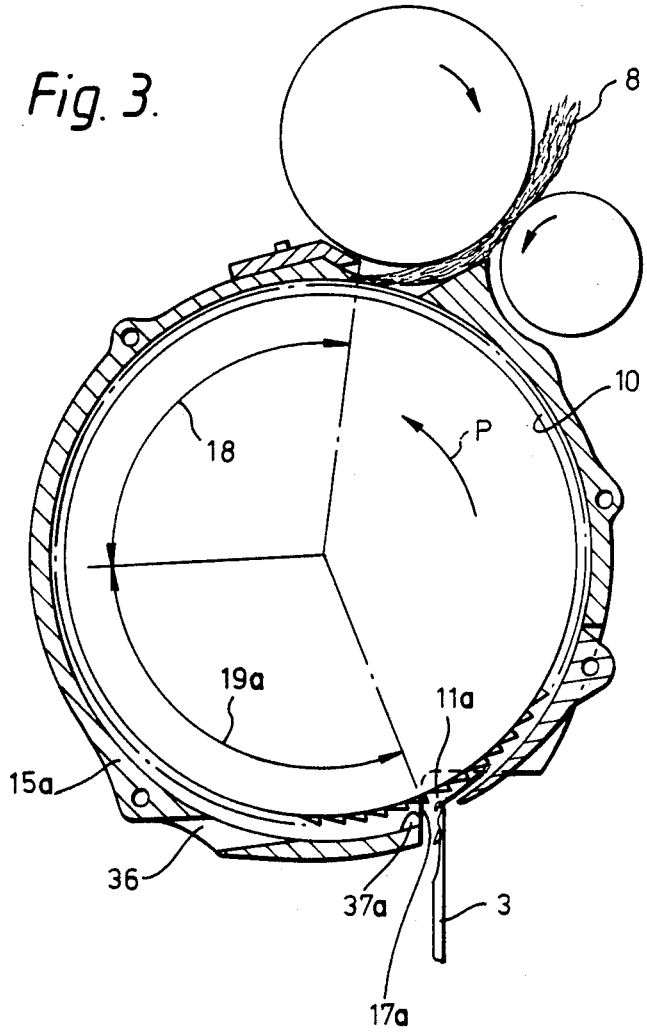
FIG. 3 is a diagrammatic representation of a cross section corresponding to FIG. 1 through a circular knitting machine with the improvement afforded by the invention.

The centrifugal forces occurred at the high rotatory speeds or circumferential velocities of the card cylinder 10 normally suffice, in the embodiments described, to release one hundred percent of the fibers from the hooks 14, and this is essential for the achievement of a great uniformity of the density of the enmeshed fibers. Since these centrifugal forces, however, do not always suffice, an opening 36 (FIGS. 3 and 7, but not shown in FIG. 4 for sake of clarity) connected to a vacuum machine or blower can be provided in the shroud 15*a*, 15*d* respectively of FIGS. 3 and 7, for the purpose of producing an auxiliary air current in the throw-off section 19*a*, 19*d* respectively to assist in the release of the fibers from the hooks 14 of the card cylinder 10 if the centrifugal forces produced by the rotation of the card cylinder 10 are too weak.

In circular knitting machines of the kind described above, the hooks 4 of the knitting needles 3 pass through the air stream carrying the released fibers 9 away from the card cylinder 10, doing so in a direction substantially perpendicular to the direction of flow of the fibers 9. This is true also in the application of other known circular knitting machines using contactless fiber feed. Studies made of the knit goods produced with such machines have shown that sometimes fibers are worked into more than one loop or stitch in the ground fabric.

Figure 4:
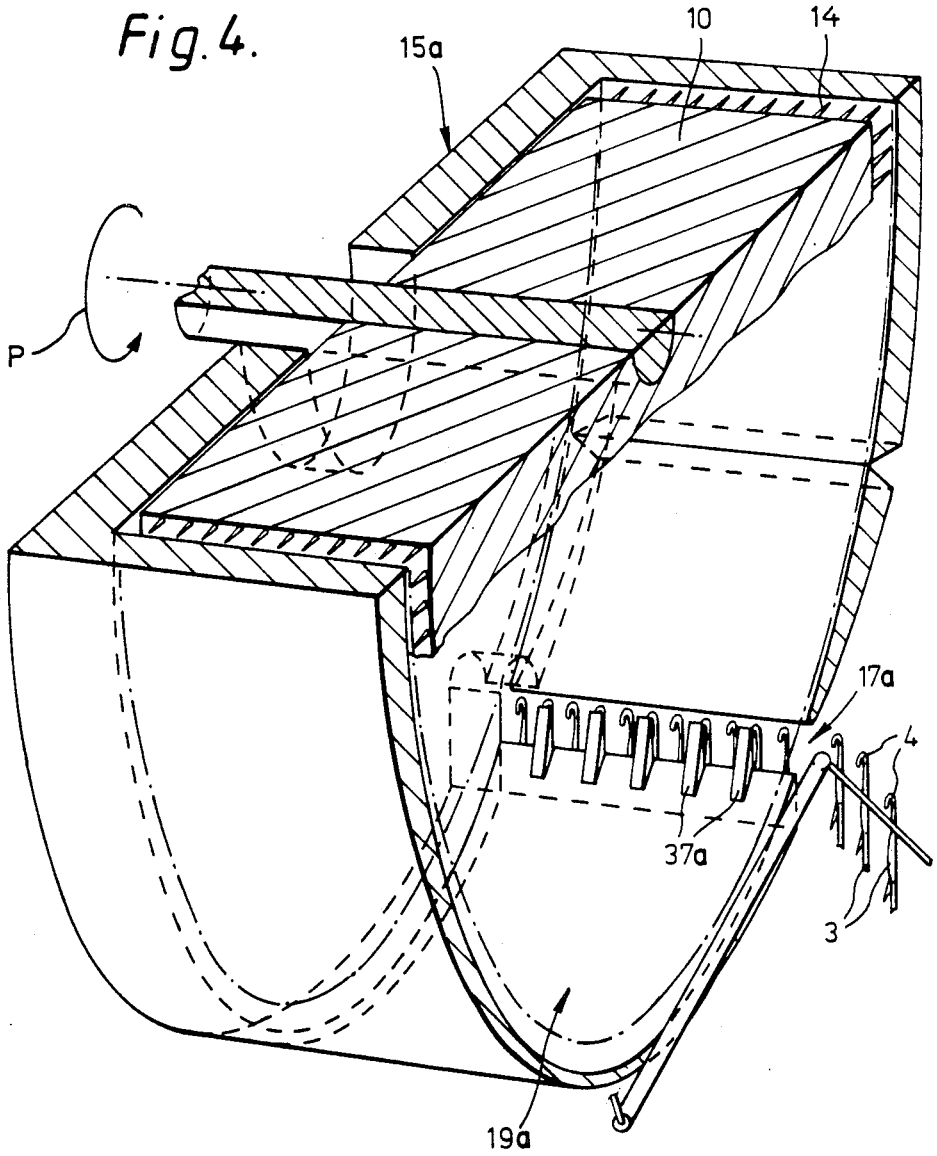
FIG. 4 is a perspective view of the part of the opening device of the circular knitting machine of FIG. 3 which includes the transfer zone.

For the control of this effect, the fiber stream flowing through the transfer zone 11 is split into separate streams before reaching the transfer zone. For this purpose, guides 37*a* (FIGS. 3 and 4) are provided in the immediate vicinity of the exit aperture 17*a*, and are fastened to the part of the shroud 15*a* that forms the throw-off section 19*a*, and are therefore located between the feed apparatus or rolls 7 and the combing-in zone 11*a* or they are formed on shroud 15*a* by machining, for example, and they are preferably made of a wear-resistant material such as ceramic or plastic. The guides 37 advantageously are arranged with constant spacing. The guides 37*a* consist, as seen in FIG. 4, for example of fins whose broad sides are parallel to the fiber stream, and which are disposed parallel and side by side in the direction of the axis of the card cylinder 10 i.e. transversely to the direction of flow of the fiber stream. The longitudinal cross section of these fins is triangular, for example, as seen in FIG. 4. The downstream edges of the guides 37*a*, in the direction of flow of the fibers, can be situated at the end of the throw-off section 19*a*, so that the exit aperture 17*a* in this case is divided by the guides 37*a* into a plurality of apertures each admitting a portion of the fiber stream.

Different numbers of fins and hence different numbers of divisions of the fiber stream can be selected. If the width of the transfer zone 11*a* and the width, parallel to its axis, of the card cylinder 10 are considered as machine constants, the number of guides 37*a* provided across the width of the transfer zone 11*a* should be approximately inversely proportional to the pitch, i.e., to the needle spacing, of the circular knitting machine involved. In other words, it is desirable to make the width of a particular portion of the fiber stream, as measured parallel to the axis of the card cylinder 10, such that, regardless of the needle pitch, not too many needle hooks 4 can be simultaneously in one and the same portion of the fiber stream. In FIG. 4, for example, this width of the portions of the fiber stream, or this distance of the guides 37*a* from one another, is advantageously such that not more than one needle hook 4 can pass simultaneously through the same portion of the fiber stream. The number of guides 37*a* thus corresponds approximately to a half of the quotient of the width of the card cylinder 10 and the the needle pitch. The width of the card cylinder 10 advantageously is at least equal to five times, preferably equal to ten times the needle spacing calculated from the needle pitch. and preferably is at least half as great as said quotient. The guides 37*a* are preferably arranged with constant spacing.

Figure 5:
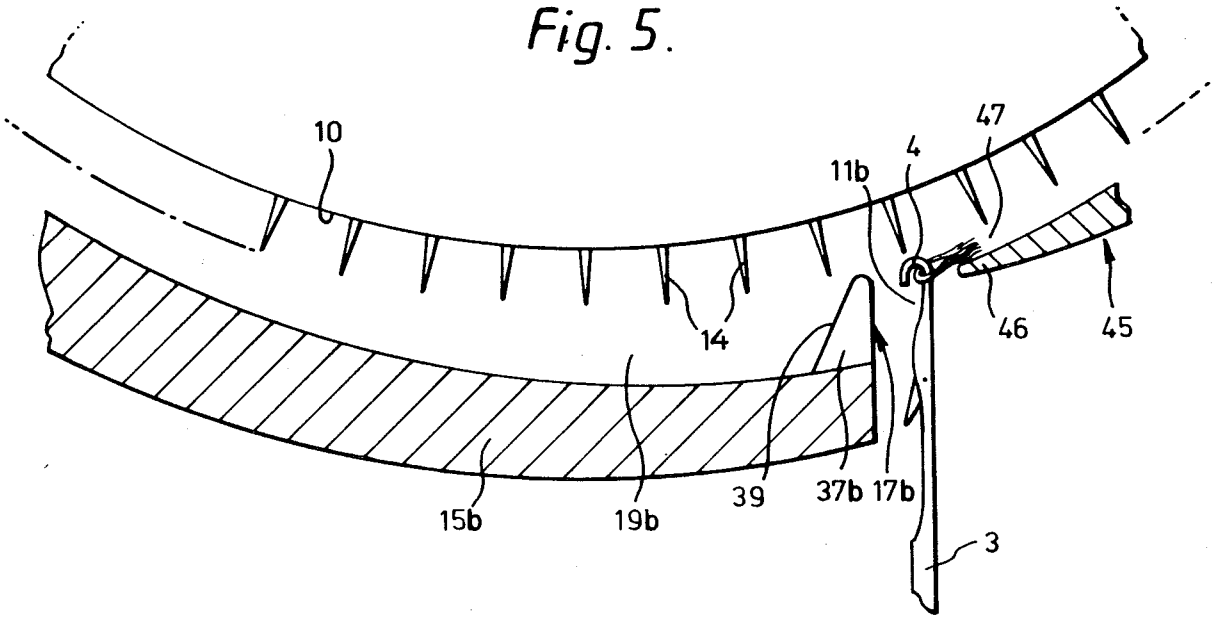

FIGS. 5 to 7 show different embodiments of the shape and arrangement of the guides. While the guides 37*b* and 37*c* in accordance with FIGS. 5 and 6 can have a longitudinal cross-sectional profile corresponding to an isosceles triangle with its base resting on the shroud 15*b* and 15*c* respectively, the longitudinal cross section of the guides 37*d* in FIG. 7 is approximately in the form of a right triangle whose longer side is fastened to a flap 38 and whose shorter side forms the downstream end of the guide. In addition, the guides can be also in the form of pins, disks, flexible elements, or the like. The thickness of the guides, measured in the axial direction of the card cylinder, is not especially critical, but it should be such that it does not interfere with the formation of secondary parallel streams of fibers and does not cause fibers to accumulate on the upstream edges of the guides. For the same reason it is also recommended that the guides 37*b* be provided with surfaces 39 sloping upwardly (FIG. 5). The distance between the downstream ends of the guides and the needles 3 on the one hand and the hooks 4 on the other, corresponding to dimension 40 in FIG. 6, can be variously selected and can be greater as the staple length of the fibers is greater. If dimension 40 is too great, the danger exists that the separate streams of fibers will recombine to form a single stream, thus defeating the purpose of the guides 37*c* which is to prevent fibers from being bound into more than one loop of the ground fabric.

The absolute height of the guides 37*c*, or dimension 41 in FIG. 6, should be made sufficiently great to enable the fibers 9 to pass through without interference. Experiments have shown that the unformity of the fiber transfer combined with the prevention of double or triple enmeshing of the fibers will be all the poorer as the dimension 41 diminishes. This can be attributed to the fact, among others, that, if the height of the guides 37*a* is too low, too many fibers flow over the guides 37*c* without forming separate streams, which can happen only if the fibers pass through the gaps between the guides 37*c*.

The difference between the level of the tips of needles 3 and that of the upper ends of the guides 37*c*, as seen in FIG. 6, corresponding to dimension 42, has the greatest influence on the percentage of the fibers that are bound into more than one loop, according to our experience thus far. In particular, the greater dimension 42 becomes, the greater this percentage becomes. As long as dimension 42 is equal to or less than the length of the hooks 4 of needles 3, i.e., smaller than the difference in level between the tip of the needle and the bottom end of the hook, this relationship remains relatively insignificant. As soon as dimension 42, however, is greater than the hook length, changes in dimension 42 manifest themselves relatively greatly in corresponding changes in the percentage of fibers bound across more than one loop. It is therefore assumed that the guides 37*c* eliminate the effect of the horizontally oriented fibers very perceptibly only when they completely mask the hooks 4 of the needles 3, i.e., when dimension 42 is smaller than the hook length, because in this case all fibers entering the open hooks 3 have to pass first through the gaps between the guides 37*c*. If dimension 42, however, is greater than the hook length, i.e, if the hooks 4 are only partially masked by the guides 37*c*, the hooks 4 can catch not only fibers 9 which are delivered through the gaps between the guides 37*c*, but also the fibers 9 which have migrated above the top edges of the guides 37*c*. Consequently, the percentage of fibers which are bound into the ground fabric across more than one loop can be controlled by varying the dimension 42.

To make use of this effect, provision is made in further development of the invention for making the guides adjustable, particularly with regard to dimension 42. For this purpose the guides 37*d* are disposed on the pivoted flap 38 in accordance with FIG. 7, and at the same time form part of the shroud 15*a*. The flap 38 is pivotally suspended at its end remote from the guides 37*d* on a pivot pin 43, and can swing in the direction of the arrow v to such an extent that dimension 42 can be varied at will. The pivot pin 43 can extend through an elongated hole 44 formed in the flap 38, which permits displacement of the guides 37*d* in the direction of flow of the fibers (arrow w) and thus permits an adjustment of dimension 40. At the same time provision can furthermore be made for the flap 38 together with the guides 37*d* to be in the form of a replaceable unit so that the shape and/or number and/or spacing of the guides 37*d* can be varied by a few manual alterations.

Lastly, provision can be made for controlling dimension 42, for example, according to a preselected pattern. It would suffice for this purpose to move the flap 38 shown in FIG. 7, for example, up and down according to a pattern. Mechanical or electromagnetic devices are available as control means for this purpose, such as those generally known for the control of other devices on circular knitting machines.

Otherwise, the embodiments shown in FIG. 5 on the one hand and in FIGS. 6 and 7 on the other differ in the construction of the throw-off section. Whereas the radial distance between the throw-off section 19*b* and the circumference of the card cylinder 10 in FIG. 5 gradually increases towards the exit aperture 17*b*, the radial distance between the throw-off section 19*c* and the card cylinder in FIG. 6 first increases and then diminishes again toward the exit aperture 17*c*, so that just ahead of the exit aperture 17*c* a kind of "ski jump" or ramp is formed, by which the freed fibers are aimed at the open hooks 4 of the needles 3. The flap 38 in FIG. 7 is designed in the same way, its radial distance from the circumference of the card cylinder constantly diminishing between the pivot pin 45 and the exit aperture 17*d*.

The invention is not limited to the embodiments described, which can be modified in many ways. Instead of the embodiment represented by FIG. 1, provision can be made, for example, in accordance with FIGS. 5 to 7, for the shroud to extend only as far as the exit aperture, and for a preferably pivoted flat 45 to be situated in back of the transfer zone, whose portion 46 adjacent the transfer zone will be streamlined and so arranged that it divides the air and fiber stream in back of the needles 3 into a mainstream and a second stream for the purpose of drawing the fibers laid into the needle hooks 4 into a wedge-shaped gap 47 between the flap 45 and the hooks 14 of the card cylinder and thus straightening them out and orienting them, thereby improving the uniformity of the fabric (FIGS. 5 to 7).

The drive 34 provided for the card cylinder 10 is a motor that is independent of the knitting machine drive and can be operated even when the circular knitting machine is stopped, so that, when the knitting machine is turned on, the card cylinder 10 will already have attained the necessary high rotatory speed and will maintain it until the knitting machine comes again to a halt. For this independent drive 34, it is not absolutely necessary to have a second, separate motor; instead, provision can be made for assuring, by means of special gearing and/or clutches, that the circular knitting machine can operate only when the card cylinder is running. Otherwise, each time that the knitting machine is stopped, areas would be found in the fabric which would have no fibers or irregularly distributed fibers. The "high" rotatory speeds of the card cylinders amounted in experimental machines to 4000 rpm for a card cylinder diameter of 125 mm, under otherwise the same circumstances as in the use of the conventional carding devices.

We claim:

1. A circular knitting machine for the manufacture of knit goods with combed-in fibers, comprising: at least one rotary needle cylinder supporting movable knitting needles having hooks and at least one carding device having a feed apparatus for a band of fibers, a combing-in zone, through which the knitting needles pass, and means for receiving said band of fibers, separating said band of fibers into individual fibers flowing in air and transporting said individual flowing fibers to the combing-in zone for being inserted contactlessly into the needle hooks, characterized in that guide means are provided between said feed apparatus and said combing-in zone for dividing said individual flowing fibers into a plurality of separate fiber streams.

2. Circular knitting machine of claim 1, characterized in that said means comprises a separating cylinder which can be driven at high circumferential velocity and is provided with card clothing and a cover confronting the circumferential surface of the separating cylinder, said cover having an entry aperture for the fiber strand which is fed by said feed apparatus, an exit aperture opening in said combing-in zone for the fibers within said streams, and a throw-off section between said apertures opening into the exit aperture and having said guide means.

3. Circular knitting machine of claim 1, characterized in that the guide means consist of fins.

4. Circular knitting machine of claim 2, characterized in that the guide means are fastened to the part of the cover forming the throw-off section.

5. Circular knitting machine of claim 1, characterized in that the guide means are disposed side by side transversely to the direction of flow of the fiber streams.

6. Circular knitting machine of claim 3, characterized in that the guide means, for the purpose of masking the hook ends of the needles, terminate at a level which corresponds at least to the level of the hook ends during combing-in of the fibers.

7. Circular knitting machine of claim 1, characterized in that the guide means are adjustably disposed.

8. Circular knitting machine of claim 7, characterized in that the guide means are fastened to an adjustable flap of the cover.

9. Circular knitting machine of claim 2, characterized in that the guide means are fastened to a replaceable part of the cover.

10. Circular knitting machine of claim 1, characterized in that the number of guide means is inversely proportional to the needle pitch.

11. Circular knitting machine of claim 1, characterized in that said means has a separating cylinder the width of which is at least equal to five times, preferably at least equal to ten times the needle spacing calculated from the needle pitch.

12. Circular knitting machine of claim 11, characterized in that the number of the guide means is at least half as great as the quotient formed from the width of the separating cylinder and the pitch of the knitting machine.

13. Circular knitting machine of claim 3, characterized in that the fins are arranged with constant spacing.

14. Circular knitting machine of claim 1, characterized in that the guide means consist of a wear-resistant material.

* * * * *